US012467320B2

(12) United States Patent
Anzai

(10) Patent No.: US 12,467,320 B2
(45) Date of Patent: Nov. 11, 2025

(54) GROUND DRILLING DEVICE

(71) Applicant: Satoshi Anzai, Yokohama (JP)

(72) Inventor: Satoshi Anzai, Yokohama (JP)

(73) Assignee: Satoshi Anzai, Yokohama (JP)

( * ) Notice: Subject to any disclaimer, the term of this patent is extended or adjusted under 35 U.S.C. 154(b) by 4 days.

(21) Appl. No.: 18/024,175

(22) PCT Filed: Sep. 13, 2021

(86) PCT No.: PCT/JP2021/033504
§ 371 (c)(1),
(2) Date: Mar. 1, 2023

(87) PCT Pub. No.: WO2022/054937
PCT Pub. Date: Mar. 17, 2022

(65) Prior Publication Data

US 2023/0272674 A1 Aug. 31, 2023

(30) Foreign Application Priority Data

Sep. 14, 2020 (JP) ..... 2020-154059

(51) Int. Cl.

| | |
|---|---|
| ***E21B 10/60*** | (2006.01) |
| ***E21B 21/01*** | (2006.01) |
| ***E21B 21/06*** | (2006.01) |
| ***E21D 9/06*** | (2006.01) |

(52) U.S. Cl.
CPC ..... *E21B 10/602* (2013.01); *E21B 21/01* (2013.01); *E21B 21/062* (2013.01); *E21D 9/0678* (2016.01)

(58) Field of Classification Search
CPC ..... E21D 9/1066; E21B 21/062
See application file for complete search history.

(56) References Cited

U.S. PATENT DOCUMENTS 3,463,231 A * 8/1969 Hutchison ..... E21B 21/14 166/371
8,919,747 B2 * 12/2014 Anzai ..... B01F 23/23123 261/122.1

FOREIGN PATENT DOCUMENTS

| | | | |
|---|---|---|---|
| CN | 111058854 | A | 4/2020 |
| JP | 57003994 | A | 1/1982 |
| JP | S6130117 | B2 | 7/1986 |
| JP | 2011246950 | A * | 12/2011 |
| JP | 2015044171 | A * | 3/2015 |

(Continued)

OTHER PUBLICATIONS

Translation of JP 2015044171A (Year: 2015).*

(Continued)

*Primary Examiner* — Blake Michener
(74) *Attorney, Agent, or Firm* — CANTOR COLBURN LLP

(57) ABSTRACT

Provided a ground drilling device capable of reducing the maintenance time by suppressing wear of the rotary blade, extending the life of each component, and reducing the frequency of drilling pipes. The ground drilling device includes: the rotary blade that excavates the ground; the lubricating liquid jetting device that jets the lubricating liquid to the rotary blade when excavating the ground, and the oxygen supply device that supplies oxygen to the lubricating liquid, in which the oxygen supply device has the bubble generating medium for supplying oxygen in a high pressure state as fine bubbles to the lubricating liquid.

2 Claims, 4 Drawing Sheets

(56) References Cited

FOREIGN PATENT DOCUMENTS

| | | | |
|---|---|---|---|
| JP | 2017078218 | A | 4/2017 |
| JP | 6370954 | B1 | 7/2018 |
| KR | 101007587 | B1 * | 1/2011 |

OTHER PUBLICATIONS

Translation of KR 101007587 (Year: 2011).*
SLB Energy Glossary entry for "drilling fluid", accessed Oct. 15, 2024 via glossary.slb.com.*
Oxford English Dictionary definition of "foam", accessed Oct. 15, 2024 via oed.com.*
International Search Report for International Application No. PCT/JP2021/033504; Mailing Date, Oct. 26, 2021.
JPO Notice of Reasons for Refusal for corresponding JP Application No. 2020-154059; Issued May 14, 2024; 4 pages.

* cited by examiner

GROUND DRILLING DEVICE

CROSS REFERENCE TO RELATED APPLICATIONS

This is the U.S. national stage of application No. PCT/JP2021/033504, filed on Sep. 13, 2021. Priority under 35 U.S.C. § 119(a) and 35 U.S.C. § 365(b) is claimed from Japanese Application No. 2020-154059, filed Sep. 14, 2020, the disclosure of which is also incorporated herein by reference.

TECHNICAL FIELD

The present invention relates to a technique of a ground drilling device.

BACKGROUND ART

Conventionally, when a tunnel is constructed in the ground, a sealing type shield machine is used as a ground drilling device. Typical examples of the shield machine include a mud water type shield machine and a mud pressure type shield machine. The mud water type shield machine performs drilling while stabilizing a working face by applying mud water pressure to the drilling face (working face) in a drilling direction. On the other hand, the mud pressure type shield machine performs drilling while stabilizing a working face by converting excavated soil and sand into mud and applying a predetermined pressure (mud pressure) to the mud.

Further, a mud concentration type shield machine utilizes the advantages of the mud water type drilling method and the mud pressure type drilling method. In the mud concentration type shield machine, mud water of high concentration is made to act on a working face or a tail void to construct soil and sand properties of high water cut-off performance, thereby preventing looseness of the natural ground. In the mud concentration type shield drilling method, the drilling cross section is larger than that of other methods, and the frictional force around the propulsion pipe during propulsion is lower, which is advantageous for construction with long-distance propulsion and many curves or large curve angles.

The mud concentration type shield machine liquefies the excavated soil by injecting and stirring an injection material of about 50 to 150% of the excavated soil to prepare high-concentration mud water. Further, by opening and closing the air pinch valve, the drilling chamber pressure is maintained in the range of the ground water pressure of +0.02 to 0.05 megapascal (MPa) while the soil is excavated and discharged. Then, the liquid soil discharged into the machine under atmospheric pressure is conveyed out to a suction tank on the ground from a discharged mud conveying pipe by a suction mud discharge device.

The high-concentration mud water containing the injection material is discharged to the front of the drilling cutter. Further, the high-concentration mud water containing the injection material is also jetted from the tail void toward the outer peripheral portion of the partition wall. The injection material is a liquid mainly composed of water containing a silica material, and the injection material is mixed with the excavated soil and liquefied to prepare high-concentration mud water, and the high-concentration mud water is made to act on a working face or a tail void to construct soil and sand of high water cut-off performance.

However, in the case of the conventional injection material, friction is generated between the liquefied high-concentration mud water and the working face, which causes wear of the working face and a load on the rotary drilling cutter. Therefore, there has been a demand for an injection material capable of enhancing lubricity. Depending on the ground in which the tunnel is constructed, hydrogen sulfide may be generated. Hydrogen sulfide causes corrosion and deterioration of metal components such as the working face. As a result, the life of the shield machine may be shortened. Therefore, an injection material capable of reducing hydrogen sulfide has been required.

A boring device is used as a ground drilling device for cutting the ground in a soil improvement method for creating a columnar improved body by cutting the ground to form a circular hole and injecting a curing agent into the circular hole during the cutting when performing a ground improvement. The boring device includes a rotary rod and a rotary bit provided at a lower end of the rotary rod. When the ground is cut, the rotary rod is rotated to rotationally drive the rotary bit, thereby drilling a hole to a predetermined depth.

In this case, friction is generated between the rotary bit and the cutting soil, and the rotary bit is worn and a load is applied to the rotary rod. Therefore, there has been a demand for a lubricant capable of enhancing lubricity with cutting soil during cutting of the rotary bit. Further, depending on the ground to be improved, hydrogen sulfide may be generated. Hydrogen sulfide causes corrosion and deterioration of metal components such as a rotary blade. As a result, the life of the boring device may be shortened. Therefore, a lubricant capable of preventing corrosion due to hydrogen sulfide has been required.

CITATIONS LIST

Patent Literature

Patent Literature 1: JP-A 63-70954 Gazette

SUMMARY OF INVENTION

Technical Problems

In view of the above problems, the present invention provides a ground drilling device capable of reducing the maintenance time by suppressing wear of the rotary blade, extending the life of each component, and reducing the frequency of drilling pipes.

Solutions to Problems

The problems to be solved by the present invention are as described above and means for solving the problems will be described below.

That is, in the present invention, a ground drilling device includes: a rotary blade that excavates a ground; a lubricating liquid jetting device that jets a lubricating liquid to the rotary blade when excavating the ground; and an oxygen supply device that supplies oxygen to the lubricating liquid, in which the oxygen supply device includes a bubble generating medium for supplying oxygen in a high pressure state as fine bubbles to the lubricating liquid.

In the present invention, the ground drilling device is a shield machine and includes: a drilling cutter having a plurality of the rotary blades; a partition wall having a cylindrical shape to which the drilling cutter is attached; a drilling chamber formed by the partition wall; a mud outlet opened in the partition wall; a high-concentration mud water facility that mixes an injection material and an excavated soil to prepare the high-concentration mud water as the lubricating liquid; a discharged mud introducing pipe having one end communicated with the mud outlet to discharge an excavated soil and sand in the drilling chamber; and a discharged mud conveying pipe that conveys the excavated soil up to the ground, in which the lubricating liquid jetting device includes: a first jetting device that jets the high-concentration mud water as the lubricating liquid from the high-concentration mud water facility to a front of the drilling cutter; and a second jetting device that jets the high-concentration mud water as the lubricating liquid from the high-concentration mud water facility to an outer peripheral portion of the partition wall, the bubble generating medium of the oxygen supply device discharges the oxygen in a high pressure state as the fine bubbles into the high-concentration mud water when the injection material and an excavated soil are mixed in the high-concentration mud water facility, and the bubble generating medium is formed of a carbon-based porous material.

In the present invention, the lubricating liquid jetting device includes a third jetting device that jets a solidifying lubricant stored in a lubricant plant to the outer peripheral portion of the partition wall, in which the bubble generating medium may discharge oxygen in a high pressure state as the fine bubbles to the solidifying lubricant in the lubricant plant.

In the present invention, the ground drilling device is a boring device for soil improvement, and includes a rotary rod extending in a vertical direction and a rotary bit provided at a lower end of the rotary rod and having a plurality of the rotary blades, in which the lubricating liquid jetting device jets the lubricating liquid to a front of the rotary bit, the bubble generating medium of the oxygen supply device discharges the oxygen in a high pressure state as the fine bubbles into the lubricating liquid in the lubricating liquid jetting device, and the bubble generating medium is formed of a carbon-based porous material.

Advantageous Effects of Invention

The present invention has the following effects.

In the present invention, by mixing fine bubbles into high-concentration mud water, the lubricity between the drilling cutter and the excavated soil and between the partition wall and the excavated soil is enhanced, and the wear of the rotary blade of the drilling cutter is suppressed. Thus, the replacement frequency of each component is reduced, and the distance between the shafts can be extended in the drilling method. Further, the maintenance time is reduced, which leads to shortening of the construction period.

DESCRIPTION OF EMBODIMENTS

Next, embodiments of the present invention will be described.

Figure 1:
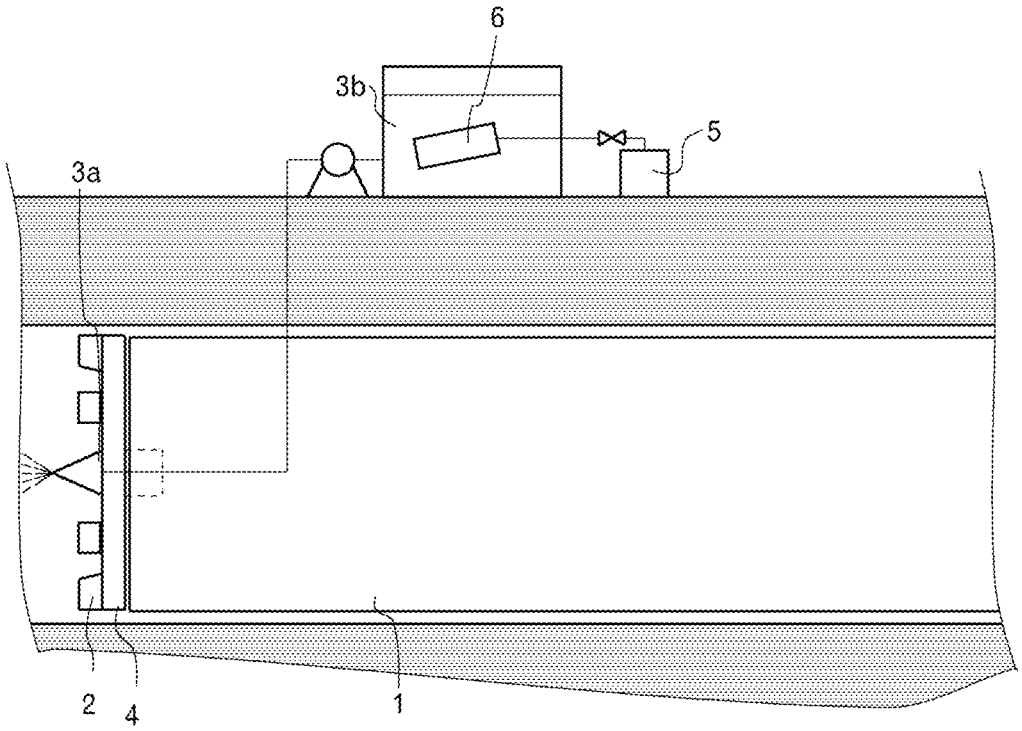
FIG. 1 is a schematic front view showing a ground drilling device according to a first embodiment of the present invention.

A ground drilling device 1 is used when constructing a tunnel in the ground or performing soil improvement by excavating the ground. As shown in FIG. 1, the ground drilling device 1 includes a rotary blade 2 for excavating the ground, and a lubricating liquid jetting device 3 for jetting a lubricating liquid to the rotary blade 2 when excavating the ground. A plurality of rotary blades 2 are arranged on a rotary body 4 which rotates around a propelling direction as an axial center, and the rotary blades 2 are rotated by the rotation of the rotary body 4 to excavate the ground. The lubricating liquid jetting device 3 jets a lubricating liquid for improving the lubricity between the rotary blade 2 and the ground.

The lubricating liquid jetting device 3 includes a nozzle 3*a* for jetting the lubricating liquid and a storage vessel 3*b* for storing the lubricating liquid.

An oxygen supply device 5 supplies oxygen to the lubricating liquid. The oxygen supply device 5 has a bubble generating medium 6 for supplying oxygen in a high pressure state to the lubricating liquid as fine bubbles. By jetting the lubricating liquid, not only the lubricity between the rotary blade 2 and the ground is improved and the durability of the rotary blade 2 is improved, but also the working time can be shortened.

Figure 2:
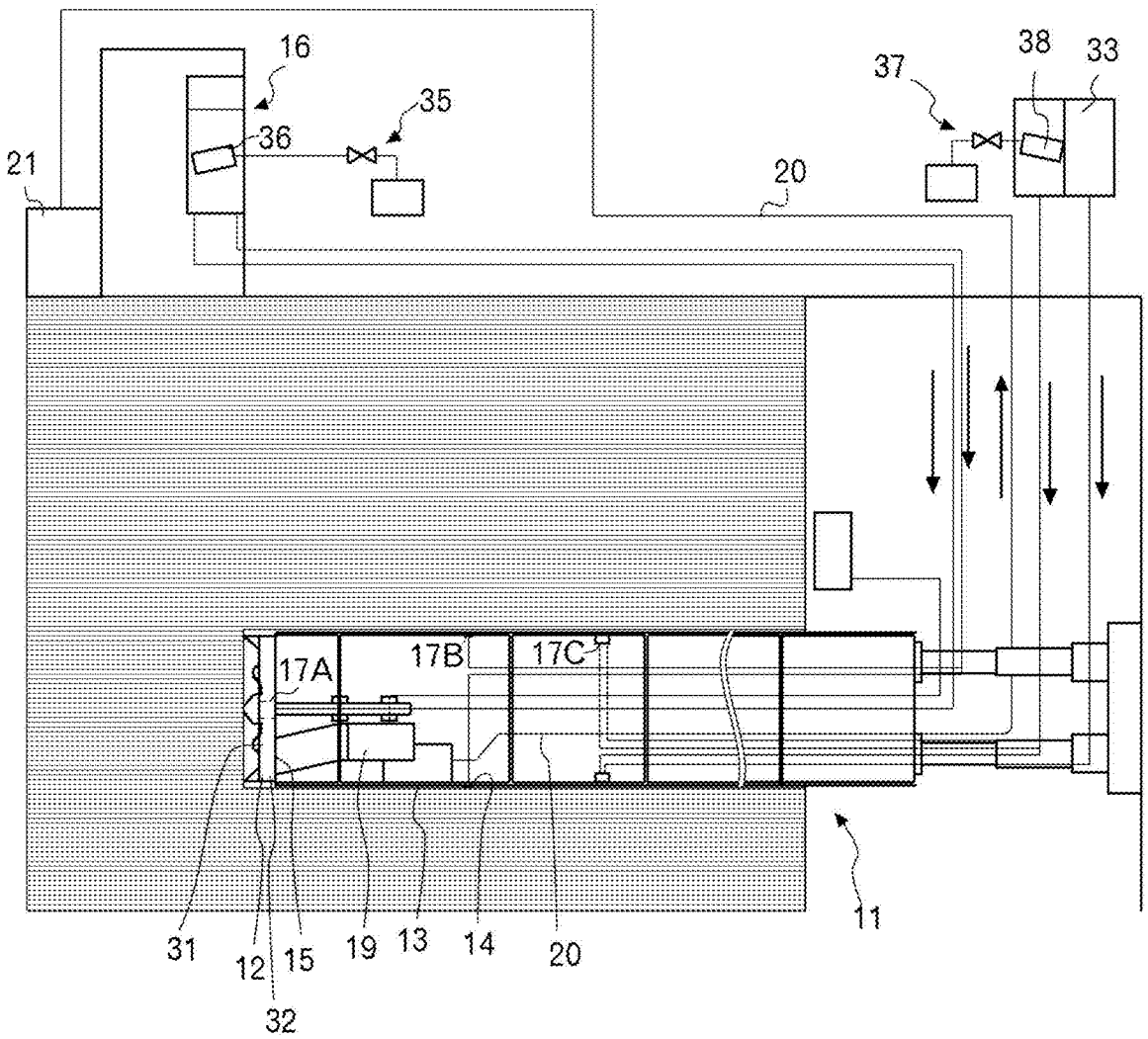
FIG. 2 is a schematic front view showing a shield machine according to a second embodiment of the present invention.

Next, an overall configuration of a shield machine 11 as a ground drilling device according to one embodiment of the present invention will be described with reference to FIG. 2.

The shield machine 11 is used when constructing a tunnel in the ground and performs drilling while stabilizing a rotary blade by applying a mud water pressure to a drilling surface in a drilling direction.

The shield machine 11 drills by a mud concentration type drilling method and liquefies excavated soil by injecting and stirring an injection material of about 50 to 150% of the excavated soil to prepare high-concentration mud water.

The shield machine 11 includes a drilling cutter 12, a cylindrical partition wall 13 to which the drilling cutter 12 is attached, a drilling chamber 14 formed by the partition wall 13, a mud outlet 15 opened in the partition wall 13, a high-concentration mud water facility 16 for mixing the injection material and the excavated soil to prepare the high-concentration mud water, and a first jetting device 17A, a second jetting device 17B and a third jetting device 17C which are lubricating liquid jetting devices. The shield machine 11 has a discharged mud introducing pipe 19 which communicates with the mud outlet 15 at one end and discharges the excavated soil in the drilling chamber 14, and a discharged mud conveying pipe 20 which conveys the excavated soil up to the ground.

In the mud concentration type drilling method, drilling is performed while maintaining the internal pressure of the drilling chamber 14 in a range of ground water pressure of +0.02 to 0.05 megapascal (MPa). The discharged liquid excavated soil is then conveyed out from the discharged mud conveying pipe 20 to a suction tank 21 on the ground.

The drilling cutter 12 of the shield machine 11 includes a disk member 31 and a plurality of rotary blades 32 arranged concentrically on the disk member 31. The disk member 31 is provided in a manner such that its axial direction is parallel to the drilling direction. The ground is excavated by the rotary blades 32 through rotating the drilling cutter 12.

The high-concentration mud water facility 16 prepares high-concentration mud water to be jetted from the first jetting device 17A and the second jetting device 17B by mixing the excavated soil conveyed out to the suction tank 21 with the injection material. The injection material is a liquid mainly composed of water containing a silica material, and the injection material is mixed with the excavated soil and liquefied to prepare the high-concentration mud water.

Here, the high-concentration mud water jetted from the first jetting device 17A is configured in a manner such that the ratio of the injection material is larger than that of the high-concentration mud water jetted from the second jetting device 17B. With this configuration, the high-concentration mud water jetted from the first jetting device 17A makes it possible to easily excavate the natural ground and increase the fluidity of the excavated soil. Further, the high-concentration mud water jetted from the second jetting device 17B can reduce the friction of the outer peripheral portion of the partition wall.

The first jetting device 17A is one aspect of the lubricating liquid jetting device and is a device for jetting high-concentration mud water as a lubricating liquid from the high-concentration mud water facility 16 to the front of the drilling cutter 12. The first jetting device 17A includes a nozzle for jetting the lubricating liquid and jets the high-concentration mud water prepared in the high-concentration mud water facility 16 toward the front of the drilling cutter 12. The high-concentration mud water jetted toward the front of the drilling cutter 12 and the excavated soil are mixed while being cut by the drilling cutter 12. At this time, since fine bubbles exist between the drilling cutter 12 and the excavated soil, the chance of contact between the excavated soil and the drilling cutter 12 is reduced, and the lubricity is enhanced.

The second jetting device 17B is one aspect of the lubricating liquid jetting device, and jets the high-concentration mud water from the high-concentration mud water facility 16 to the outer peripheral portion of the partition wall 13 as the lubricating liquid. The second jetting device 17B includes a nozzle provided on the outer peripheral portion of the partition wall 13 and jets the high-concentration mud water prepared in the high-concentration mud water facility 16 toward the outer periphery of the partition wall.

The third jetting device 17C is one aspect of the lubricating liquid jetting device and jets a solidifying lubricant to the outer peripheral portion of the partition wall 13. The solidifying lubricant is gelled by mixing a plurality of liquids stored in a lubricant plant 33, and when the lubricant is gelled, dilution by groundwater or the like does not occur, and a long-term lubricant effect can be obtained. In addition, by gelling after injection, the voids are filled, making it difficult for the unexcavated natural ground to collapse.

A bubble generating medium 38 of an oxygen supply device 37 discharges oxygen in a high pressure state into the high-concentration mud water as fine bubbles when the injection material and the excavated soil are mixed in the high-concentration mud water facility 16.

The oxygen in the high pressure state refers to oxygen having a pressure higher than the atmospheric pressure by 0 to 1.5 megapascal (MPa), and the oxygen whose pressure is regulated by a pressure regulating valve is discharged into the high-concentration mud water.

The bubble generating medium 38 has a large number of fine pores having a diameter of several nanometers to several tens of micrometers. The bubble generating medium 38 is a conductor, and the bubbles generated from the bubble generating medium 38 are negatively charged. In other words, when the ultrafine bubbles pass through the bubble generating medium 38 which is a conductor, free electrons are attached to the ultrafine bubbles, whereby the ultrafine bubbles are negatively charged. Due to this negative charge, the bubbles repel each other, and thus can be prevented from coalescing into large bubbles.

The bubble generating medium 38 is composed of a carbon-based porous material. The carbon-based porous material is a composite material containing only carbon or carbon and ceramic and is an inorganic material. A film having a thickness of several nanometers is formed on the surface of the carbon-based porous material. The film is formed of an inorganic film containing silicon. The "fine bubbles" as used herein refer to bubbles having a size (diameter) of less than 100 μm at normal temperature and pressure.

With this configuration, when the shield machine 11 rotates the disk member 31 and excavates the ground with the rotary blade 32, fine bubbles are contained in the solidifying lubricant jetted from the third jetting device 17C. The fine bubbles burst in the solidifying lubricant to reduce friction at the outer peripheral portion of the partition wall 13.

In addition, depending on the ground, hydrogen sulfide in the ground may be jetted into the tunnel due to drilling. Hydrogen sulfide causes each component of the shield machine 11 to sulfurize and deteriorate. However, since hydrogen sulfide can be decomposed into sulfur and water by containing oxygen in the form of fine bubbles in the high-concentration mud water, the sulfurization of each component can be suppressed. As a result, the life of each component can be extended and the maintenance time can be shortened.

Further, when the shield machine 11 excavates the ground, fine bubbles are contained in the high-concentration mud water jetted from the second jetting device 17B toward the outer peripheral side of the partition wall 13. The fine bubbles burst in the high-concentration mud water to form a gas layer between the partition wall 13 and the ground, thereby improving the lubricity.

The bubble generating medium 38 for the lubricant discharges oxygen in a high pressure state to the solidifying lubricant as fine bubbles when the injection material and the excavated soil are mixed in the lubricant plant 33.

With this configuration, the speed at which the two liquids are mixed is increased, and a gel-like lubricant is quickly obtained. Further, when the shield machine 11 excavates the ground, fine bubbles are contained in the lubricant jetted from the third jetting device 17C toward the outer peripheral side of the partition wall 13. The fine bubbles burst in the high-concentration mud water to form a gas layer between the partition wall and the ground, thereby improving the lubricity.

Figure 3:
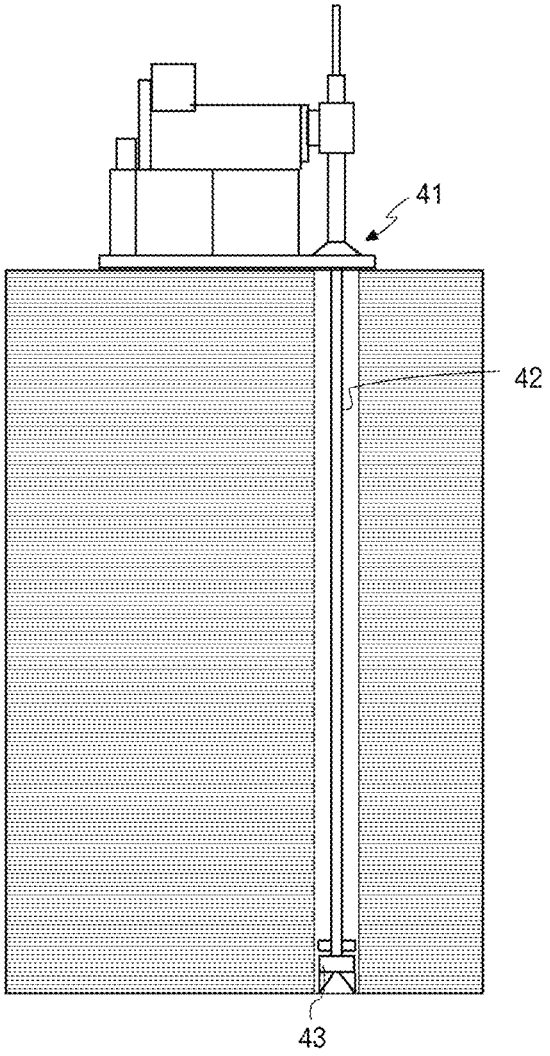
FIG. 3 is a schematic front view showing an ultrahigh-pressure jet flow apparatus according to a third embodiment of the present invention.
Figure 4:
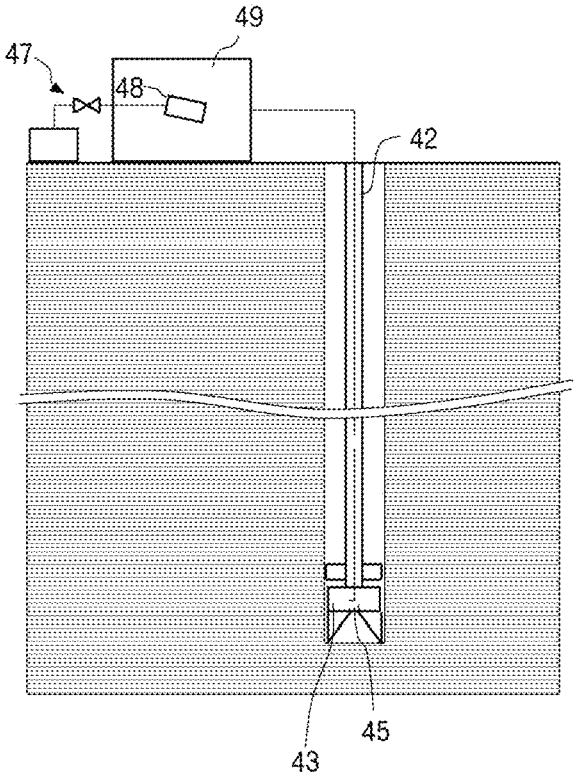
FIG. 4 is a schematic front view showing a drill bit of the ultrahigh-pressure jet flow apparatus according to the third embodiment of the present invention.

As another embodiment, an overall configuration of a boring device 41 as a ground drilling device will be described with reference to FIGS. 3 and 4.

The boring device 41 cuts the ground in a soil improvement method for creating a cylindrical improved body by cutting the ground to form a circular hole and injecting a curing agent into the circular hole when improving the ground.

The boring device 41 includes a rotary rod 42 and a rotary bit 43 provided at a lower end of the rotary rod 42.

When the ground is cut, first, the rotary rod 42 is rotated to rotationally drive the rotary bit 43, thereby drilling a hole to a predetermined depth. The excavated mud is conveyed to the outside of the circular hole. After the circular hole is formed, a curing agent is injected into the circular hole to perform soil improvement for creating a columnar improved body.

The boring device 41 includes a lubricating liquid jetting device 45. The lubricating liquid jetting device 45 jets a lubricant capable of enhancing the lubricity with cutting soil during cutting of the rotary bit 43. The lubricating liquid jetting device 45 includes a jetting nozzle and is provided in the vicinity of the rotary bit 43.

A bubble generating medium 48 of an oxygen supply device 47 discharges oxygen in a high pressure state into the lubricating liquid as fine bubbles in a lubricating liquid tank 49 that supplies the lubricating liquid to the lubricating liquid jetting device 45. The bubble generating medium 48 has a large number of fine pores having a diameter of several micrometers to several tens of micrometers. The bubble generating medium is a conductor, and the bubbles generated from the bubble generating medium are negatively charged. In other words, when the ultrafine bubbles pass through the bubble generating medium which is a conductor, free electrons are attached to the ultrafine bubbles, whereby the ultrafine bubbles are negatively charged. Due to this negative charge, the bubbles repel each other, and thus can be prevented from coalescing into large bubbles.

The bubble generating medium 48 is composed of a carbon-based porous material. The carbon-based porous material is a composite material containing only carbon or carbon and ceramic and is an inorganic material. A film having a thickness of several nanometers is formed on the surface of the carbon-based porous material. The film is formed of an inorganic film containing silicon. The "fine bubbles" as used herein refer to bubbles having a size (diameter) of less than 100 μm at normal temperature and pressure.

When the rotary rod 42 is rotated and driven, the lubricating liquid is jetted from the lubricating liquid jetting device 45. With this configuration, when the boring device 41 excavates the ground, fine bubbles are contained in the lubricating liquid jetted from the lubricating liquid jetting device 45. The high-concentration mud water jetted toward the front of the rotary bit 43 and the excavated soil are mixed while being cut by the rotary bit 43. At this time, since fine bubbles exist between the rotary bit 43 and the excavated soil, the chance of contact between the excavated soil and the rotary bit 43 is reduced, and the lubricity is enhanced.

In addition, depending on the ground, hydrogen sulfide in the ground may be jetted into the tunnel due to drilling. Hydrogen sulfide causes each component of the boring device 41 to sulfurize and deteriorate. However, since hydrogen sulfide can be decomposed into sulfur and water by containing oxygen in the form of fine bubbles in the lubricating liquid, the sulfurization of each component can be suppressed. As a result, the life of each component can be extended and the maintenance time can be shortened.

As described above, the ground drilling device 1 includes: the rotary blade 2 that excavates the ground; the lubricating liquid jetting device 3 that jets the lubricating liquid to the rotary blade 2 when excavating the ground, and the oxygen supply device 5 that supplies oxygen to the lubricating liquid, in which the oxygen supply device 5 has the bubble generating medium 6 for supplying oxygen in a high pressure state as fine bubbles to the lubricating liquid.

With such a configuration, wear of each member of the ground drilling device 1 is suppressed by supplying oxygen to the lubricating liquid as fine bubbles. Thus, the replacement frequency of each member of the ground drilling device 1 can be reduced, and the distance of the shaft to be drilled can be extended. In addition, the time required for replacing the rotary blade 2 is reduced in boring. The construction period can also be shortened in the shield drilling method. Further, since the diffusion and the lubricity are improved by using fine bubbles, it is possible to reduce the amount of bentonite or a diffusing agent which has been conventionally used for improving the lubricity.

In addition, when underground tunnel construction is performed at a shallow depth, hydrogen sulfide gas may be jetted from the ground, however, by performing drilling while mixing oxygen in the form of fine bubbles into the lubricant, hydrogen sulfide is oxidized to sulfur, and deterioration of each member due to sulfurization can be suppressed.

In addition, by mixing oxygen in the form of fine bubbles, the amount of oxygen (40 to 50 mg/L) can be 8 times the normal saturated oxygen amount of the lubricating liquid, and the duration can be maintained longer than that of the high-concentration oxygenated water of the normal pressure dissolution type.

Since high-concentration oxygen is harmless to organisms and the environment, the load on the natural environment can be reduced at the time of natural discharge.

The ground drilling device is the shield machine 11 and includes: the drilling cutter 12 having a plurality of rotary blades 32; the cylindrical partition wall 13 to which the drilling cutter 12 is attached; the drilling chamber 14 formed by the partition wall 13; the mud outlet 15 opened in the partition wall 13; the high-concentration mud water facility 16 that mixes the injection material and the excavated soil to prepare a high-concentration mud water as the lubricating liquid; the discharged mud introducing pipe 19 having one end communicated with the mud outlet 15 to discharge the excavated soil and sand in the drilling chamber 14; and the discharged mud conveying pipe 20 that conveys the excavated soil and sand up to the ground, in which the lubricating liquid jetting device includes: the first jetting device 17A that jets the high-concentration mud water as a lubricating liquid from the high-concentration mud water facility 16 to the front of the drilling cutter 12; and the second jetting device 17B that jets the high-concentration mud water as a lubricating liquid from the high-concentration mud water facility 16 to the outer peripheral portion of the partition wall 13, the bubble generating medium 36 of the oxygen supply device 35 discharges oxygen in a high pressure state as fine bubbles into the high-concentration mud water when the injection material and the excavated soil are mixed in the high-concentration mud water facility 16, and the bubble generating medium 36 is formed of a carbon-based porous material.

With this configuration, the high-concentration mud water jetted from the first jetting device 17A makes it possible to easily excavate the natural ground and increase the fluidity of the discharged mud. Further, the high-concentration mud water jetted from the second jetting device 17B can reduce the friction of the outer peripheral portion of the partition wall.

The lubricating liquid jetting device has the third jetting device 17C that jets the solidifying lubricant stored in the lubricant plant 33 to the outer peripheral portion of the partition wall 13, in which the bubble generating medium 38 discharges oxygen in a high pressure state as fine bubbles to the solidifying lubricant in the lubricant plant 33.

With this configuration, fine bubbles are contained in the solidifying lubricant jetted from the third jetting device 17C. The fine bubbles burst in the solidifying lubricant to reduce friction at the outer peripheral portion of the partition wall 13.

The ground drilling device is a boring device 41 for soil improvement, and includes the rotary rod 42 extending in the vertical direction and the rotary bit 43 provided at the lower end of the rotary rod 42 and having a plurality of rotary blades, in which the lubricating liquid jetting device 45 jets the lubricating liquid to the front of the rotary bit 43, the bubble generating medium 48 of the oxygen supply device 47 discharges oxygen in a high pressure state as fine bubbles into the lubricating liquid in the lubricating liquid jetting device 45, and the bubble generating medium 48 is formed of a carbon-based porous material.

With this configuration, in the boring process, a gas layer is formed between the rotary bit 43 and the ground to improve the lubricity. Further, since hydrogen sulfide can be decomposed into sulfur and water by containing oxygen in the form of fine bubbles in the lubricating liquid, the sulfurization of each component can be suppressed. As a result, the life of each component can be extended and the maintenance time can be shortened.

The ground drilling device according to the present embodiment is not limited to a shield machine or a boring device and can be applied to any drilling machine having a rotary blade. For example, the present invention can be applied to a drilling machine for boring a back ground of an earth retaining pile or a pressure receiving board in a ground anchoring method, and a drilling device for a deep treatment method for excavating contaminated soil in order to solidify a contaminant deposited in a harbor, a river, a lake, or the like. The present invention can also be applied to an ultra-high-pressure jet flow apparatus that drills a hole to a planned depth by a rotary rod and then rotates and jets an ultrahigh-pressure curing agent liquid into the ground by rotation of a nozzle to cut the ground and simultaneously create a cylindrical improved body.

INDUSTRIAL APPLICABILITY

The present invention is applicable in a technique of a ground drilling device.

REFERENCE SIGNS LIST

1 Ground drilling device
2 Rotary blade
3 Lubricating liquid jetting device
3*a* Nozzle
3*b* Storage vessel
4 Rotary body
5 Oxygen supply device
6 Bubble generating medium
11 Shield machine
12 Drilling cutter
13 Partition wall
14 Drilling chamber
15 Mud outlet
16 High-concentration mud water facility
17A First jetting device (Lubricating liquid jetting device)
17B Second jetting device (Lubricating liquid jetting device)
17C Third jetting device (Lubricating liquid jetting device)
19 Discharged mud introducing pipe
20 Discharged mud conveying pipe
21 Suction tank
31 Disk member
32 Rotary blade
33 Lubricant plant
35 Oxygen supply device
36 Bubble generating medium
37 Oxygen supply device
38 Bubble generating medium
41 Boring device
42 Rotary rod
43 Rotary bit
45 Lubricating liquid jetting device
47 Oxygen supply device
48 Bubble generating medium
49 Lubricating liquid tank

The invention claimed is:

1. A ground drilling device comprising:
a rotary blade that excavates a ground;
a lubricating liquid jetting device that jets a lubricating liquid to the rotary blade when excavating the ground; and
an oxygen supply device that is disposed on the ground and supplies oxygen to the lubricating liquid,
wherein the oxygen supply device includes a bubble generating medium for supplying oxygen having a pressure up to 1.5 megapascals (MPa) higher than the atmospheric pressure as fine bubbles to the lubricating liquid,
the ground drilling device being a shield machine and further comprising:
a drilling cutter having a plurality of the rotary blades;
a partition wall having a cylindrical shape to which the drilling cutter is attached;
a drilling chamber formed by the partition wall;
a mud outlet opened in the partition wall;
a high-concentration mud water facility that is disposed on the ground and mixes an injection material and an excavated soil to prepare a high-concentration mud water as the lubricating liquid;
a discharged mud introducing pipe having one end communicated with the mud outlet to discharge an excavated soil and sand in the drilling chamber;
a suction tank that is disposed on the ground and on one side of the high-concentration mud water facility; and
a discharged mud conveying pipe that is connected to the suction tank and conveys the excavated soil and sand up to the ground,
wherein
the lubricating liquid jetting device includes: a first jetting device that jets the high-concentration mud water as the lubricating liquid from the high-concentration mud water facility to a front of the drilling cutter; and a second jetting device that jets the high-concentration mud water as the lubricating liquid from the high-concentration mud water facility to an outer peripheral portion of the partition wall,
the bubble generating medium of the oxygen supply device discharges the oxygen having the pressure as the fine bubbles into the high-concentration mud water when the injection material and an excavated soil are mixed in the high-concentration mud water facility, and
the bubble generating medium is formed of a carbon-based porous material.

2. The ground drilling device according to claim 1, wherein the lubricating liquid jetting device includes a third jetting device that jets a solidifying lubricant stored in a lubricant plant to the outer peripheral portion of the partition wall, and the bubble generating medium discharges the oxygen having the pressure as the fine bubbles to the solidifying lubricant in the lubricant plant.

* * * * *